US007059789B2

(12) United States Patent
Chiang

(10) Patent No.: US 7,059,789 B2
(45) Date of Patent: Jun. 13, 2006

(54) KEY STRUCTURE

(75) Inventor: Chih-Hsiang Chiang, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 10/835,048

(22) Filed: Apr. 29, 2004

(65) Prior Publication Data

US 2004/0223799 A1 Nov. 11, 2004

(30) Foreign Application Priority Data

May 7, 2003 (TW) ..... 92112396 A

(51) Int. Cl.
*B41J 5/16* (2006.01)

(52) U.S. Cl. ..... 400/490; 400/400; 400/472

(58) Field of Classification Search ..... 400/490, 400/495, 491.2, 496, 472; 200/341–345; 345/360, 361
See application file for complete search history.

(56) References Cited

U.S. PATENT DOCUMENTS

| | | | | |
|---|---|---|---|---|
| 5,278,371 | A * | 1/1994 | Watanabe et al. | 200/344 |
| 5,878,872 | A * | 3/1999 | Tsai | 200/344 |
| 6,011,227 | A * | 1/2000 | Yoneyama | 200/344 |
| 6,040,541 | A * | 3/2000 | Li | 200/344 |
| 6,328,489 | B1 * | 12/2001 | Chi-Pin | 400/496 |
| 6,550,993 | B1 * | 4/2003 | Lu et al. | 400/490 |

FOREIGN PATENT DOCUMENTS

TW 503412 9/2002

* cited by examiner

*Primary Examiner*—Anthony H. Nguyen
(74) *Attorney, Agent, or Firm*—Quintero Law Office

(57) ABSTRACT

A key structure. The key structure comprises a substrate, a key cover, a first rod and a resilient member disposed between the substrate and the key cover. The key cover has a receiving seat defining an opening and a receiving space. Particularly, the length of the opening is less than the receiving space, and the opening is offset with respect to the center of the receiving space. The first rod has a first end connecting the key cover and a second end connecting the substrate, wherein the first end has a protrusion passing through the opening into the receiving space.

9 Claims, 2 Drawing Sheets

KEY STRUCTURE

BACKGROUND OF THE INVENTION

1. Field of the Invention

The present invention relates in general to a key structure and in particular to a key structure easy for assembly and disassembly, preventing separation of the key cover.

2. Description of the Related Art

Referring to FIG. 1, the conventional scissors type key structure primarily comprises a substrate 11, a first rod 12, a second rod 13, a resilient member 14 and a key cover 15. The first rod 12 has a first protrusion 16 and a second protrusion 17. The second rod 13 has a third protrusion 18 and a fourth protrusion 19. The first protrusion 16 rotatably connects the first receiving seat 20 of the key cover 15, and the second protrusion 17 rotatably and slideably connects the first convex trough 21 of the substrate 11 respectively. Moreover, the third and fourth protrusions 18, 19 rotatably connect the second convex trough 22 of the key cover 15 and the second receiving seat 23 of the substrate 11 respectively. With respect to the conventional scissors type key structure as shown in FIG. 1, the key cover 15 moves downward when the key is pressed. Subsequently, the key cover 15 can be raised upward due to the elastic force from the resilient member 14 disposed between the substrate 11 and the key cover 15.

To avoid separation of the key cover 15 from the first rod 12 after assembly, as shown in FIG. 2, the first receiving seat 20 defines a receiving space 25 and an opening 24 aligned to the center C thereof, wherein the width a of the opening 24 is less than the diameter b of the receiving space 25, and the diameter d of the first protrusion 16 is less or equal to the diameter b of the receiving space 25. When assembling the conventional key structure 1, the first protrusion 16 is inserted through the opening 24 into the receiving space 25 to securely connect the key cover 15, thus preventing separation.

As mentioned, the first protrusion 16 is securely joined in the receiving space 25 due to the width of opening 24 being less than the diameter of first protrusion 16. This method of assembly, however, is difficult and inconvenient. Furthermore, the key structure may be damaged when the first protrusion 16 is inserted through the small opening 24.

SUMMARY OF THE INVENTION

Accordingly, an object of the present invention is to provide a key structure. The key structure comprises a substrate, a key cover, a first rod and a resilient member disposed between the substrate and the key cover. The key cover has a receiving seat defining an opening and a receiving space. Particularly, the length of the opening is less than the receiving space, and the opening is offset with respect to the center of the receiving space. The first rod has a first end connecting the key cover and a second end connecting the substrate, wherein the first end has a protrusion passing through the opening into the receiving space. The protrusion is rotatably fitted in the receiving space without rectilinear movement.

DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
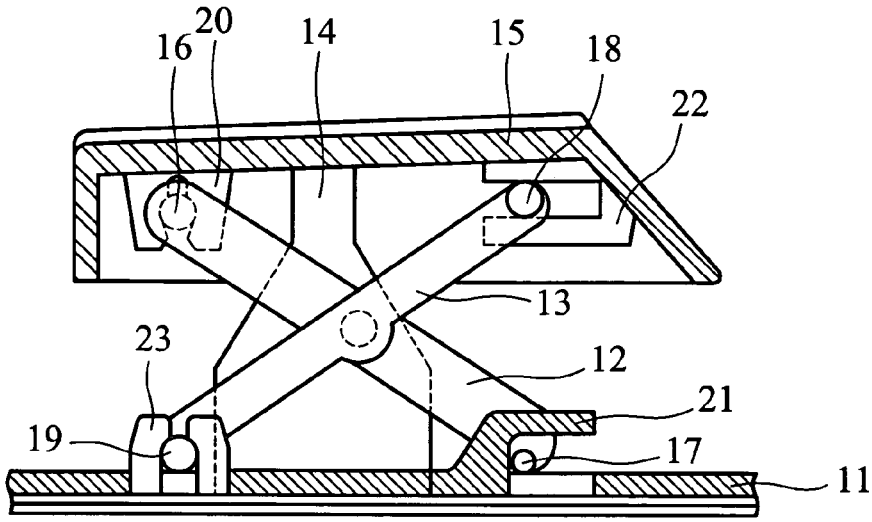
FIG. 1 ( RELATED ART )
FIG. 1 is a sectional view of a conventional key structure.
Figure 2:
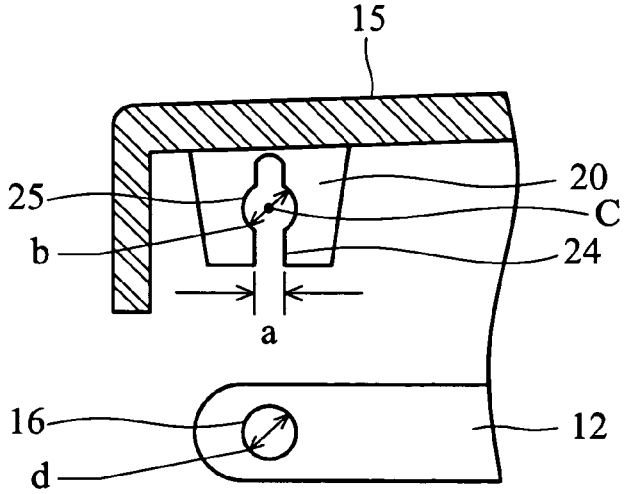
FIG. 2 ( RELATED ART )
FIG. 2 is a local sectional view illustrating the first protrusion, the key cover, and the receiving seat of FIG. 1.
Figure 3:
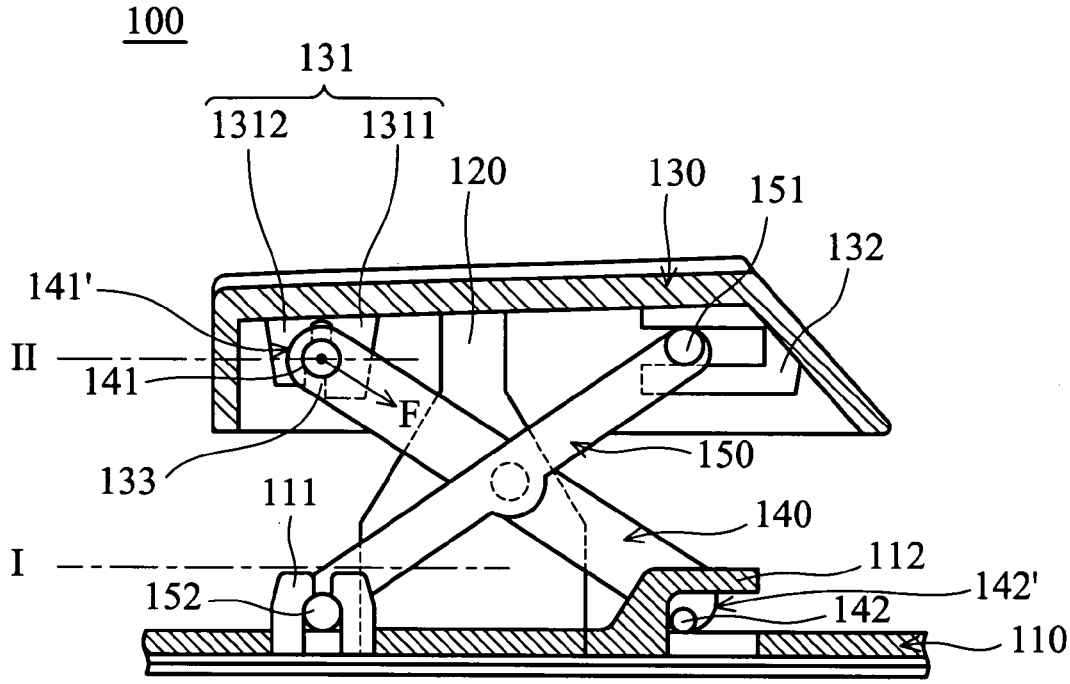
FIG. 3 is a sectional view of the key structure in accordance with the present invention.

Referring to FIG. 3, the key structure 100 of this embodiment primarily comprises a substrate 110, a key cover 130, a first rod 140, a second rod 150 and a resilient member 120 disposed between the key cover 130 and the substrate 110. The substrate 110 has a first receiving seat 111 and a first convex trough 112, moreover, the key cover 130 has a second receiving seat 131 and a second convex trough 132.

Figure 4:
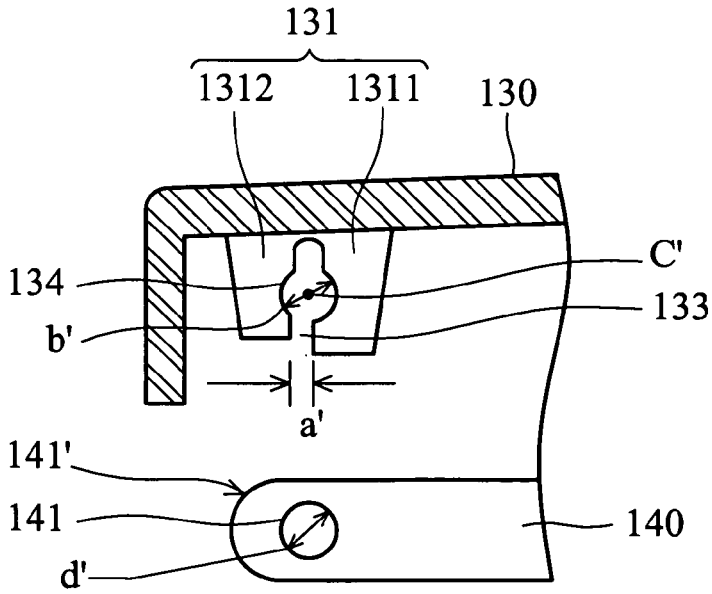
FIG. 4 is a local sectional view illustrating the first protrusion, the key cover, and the receiving seat of FIG. 3 in accordance with the present invention.

In FIG. 3, the first rod 140 has a first end 141' provided with a first protrusion 141 and a second end 142' provided with a second protrusion 142. As shown in FIG. 4, the first protrusion 141 is located in a substantially circular receiving space 134 to rotatably connect the second receiving seat 131. The second protrusion 142 rotatably and slideably connects the first convex trough 112. Similarly, the second rod 150 has a third protrusion 151 and a fourth protrusion 152 rotatably connecting the second convex trough 132 of the key cover 130 and the first receiving seat 111 of the substrate 110 respectively.

When assembling the key cover 130, the first protrusion 141 is inserted through the opening 133 into the receiving space 134 by pressing the key cover 130 downward in the first position I as shown in FIG. 3. Subsequently, the key cover 130 is raised to the second position II spontaneously due to the elastic force from the compressed resilient member 120. Thus, the first protrusion 141 and the receiving seat 131 are pivoted, and the key cover 130 is movable between the first and second position I, II after assembly.

Referring to FIG. 4, the second receiving seat 131 has a first flange 1311 and a second flange 1312 projecting from the key cover 130, wherein the first flange 1311 is longer than the second flange 1312 and closer to the second end 142' of the first rod 140. Moreover, the second receiving seat 131 defines an opening 133 and a receiving space 134, wherein the width a' of the opening 133 is less than the diameter b' of the receiving space 134. As shown in FIG. 4, the opening 133 is slightly offset with respect to the center C' of the receiving space 134 such that the first protrusion 141 and the first flange 1311 have a contact area and joining strength greater than the second flange 1312. Thus, when the key structure 100 encounters an external force F applied between the first flange 1311 and the first protrusion 141 along the direction of first rod 140 as shown in FIG. 3, the second receiving seat 131 and the first protrusion 141 can provide better joining strength, preventing separation. As the first flange 1311 is longer than the second flange 1312 forming a L-shaped profile, it is also easier to align the first protrusion 141 with the opening 133 during assembly.

In summary, the present invention provides a key structure preventing separation of the first protrusion 141 from the receiving seat 131 due to the opening 133 being offset from the center C' of the receiving space 134. As mentioned, the first flange 1311 of the second receiving seat 131 is longer than the second flange 1312, forming an L-shaped profile, thus facilitating the alignment of the first protrusion 141 with the opening 133, simplifying assembly.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A key structure, comprising:

a substrate;

a key cover, comprising a first flange and a second flange defining a receiving space and an opening offset with respect to the center of the receiving space;

a first rod, comprising a first end connecting the key cover and a second end connecting the substrate, wherein the first end comprises a protrusion; and a resilient member disposed between the substrate and the key cover;

wherein the first flange is longer and closer to the second end than the second flange, and the protrusion is rotatably fitted in the receiving space without rectilinear movement, and the opening is offset with respect to the center of the receiving space in a direction away from the second end such that a contact area between the first flange and the protrusion is greater than a contact area between the second flange and the protrusion when the protrusion is received in the receiving space.

2. The key structure as claimed in claim 1 further comprising a second rod connecting the key cover and the substrate.

3. The key structure as claimed in claim 1, wherein the receiving space is substantially circular.

4. A key structure, comprising:

a substrate;

a first rod, comprising a first end including a protrusion and a second end connecting to the substrate; and a key cover, comprising a first flange and a second flange together defining a receiving space and an opening, wherein the first flange is closer to the second end than the second flange, and the receiving space is proportioned to receive the protrusion such that the protrusion is rotatably fitted in the receiving space without rectilinear movement;

wherein the opening is offset with respect to the center of the receiving space in a direction away from the second end such that a contact area between the first flange and the protrusion is greater than a contact area between the second flange and the protrusion when the protrusion is received in the receiving space.

5. The key structure as claimed in claim 4, further comprising a resilient member disposed between the substrate and the key cover.

6. The key structure as claimed in claim 4, wherein the first flange is longer than the second flange.

7. The key structure as claimed in claim 4, wherein the cross-section of the receiving space is circular.

8. The key structure as claimed in claim 7, wherein the cross-section of the protrusion is circular.

9. The key structure as claimed in claim 4, further comprising a second rod connecting the key cover and the substrate.

* * * * *